United States Patent [19]

Johansson

[11] 4,108,254

[45] Aug. 22, 1978

[54] DRILLING APPARATUS

[75] Inventor: Ake Johansson, Skelleftea, Sweden

[73] Assignee: Linden-Alimak AB, Skelleftea, Sweden

[21] Appl. No.: 735,469

[22] Filed: Oct. 26, 1976

Related U.S. Application Data

[63] Continuation of Ser. No. 573,064, Apr. 29, 1975, abandoned.

[30] Foreign Application Priority Data

May 7, 1974 [SE] Sweden ..... 7406100

[51] Int. Cl.[2] ..... E21B 5/00

[52] U.S. Cl. ..... 173/43; 285/134

[58] Field of Search ..... 173/43; 285/134; 212/66–69

[56] References Cited

U.S. PATENT DOCUMENTS

| | | | |
|---|---|---|---|
| 2,588,928 | 3/1952 | Humpal et al. | 212/68 UX |
| 2,820,650 | 1/1958 | Leopold | 285/134 |
| 3,166,344 | 1/1965 | Davis | 285/134 |
| 3,240,279 | 3/1966 | Dorkins | 173/43 |
| 3,424,318 | 1/1969 | Lorence | 212/69 |
| 3,470,969 | 10/1969 | Arcangeli | 173/43 |
| 3,477,746 | 11/1969 | Watson | 212/68 X |
| 3,517,694 | 6/1970 | Lieffring | 285/134 X |
| 3,533,515 | 10/1970 | Milner | 212/69 |
| 3,711,047 | 1/1973 | O'Leary | 173/43 X |
| 3,743,223 | 7/1975 | Spellman | 212/66 X |

*Primary Examiner*—Ernest R. Purser
*Assistant Examiner*—William F. Pate, III

[57] ABSTRACT

A fluid operated drill is supported upon a boom, which is in turn supported upon a mechanism for moving the boom to different positions, the mechanism being rotatable about a central axis with respect to a relatively stationary frame. A fluid collector means is provided including circumferential grooves communicating with channels for conducting operating fluids from the frame to the positioning mechanism and the fluid operated drill.

9 Claims, 8 Drawing Figures

DRILLING APPARATUS

CROSS-REFERENCES TO RELATED APPLICATIONS

This is a continuation of application Ser. No. 573,064, filed Apr. 29, 1975 now abandoned.

The present invention is particularly adapted for heavy duty drilling apparatus, which may have a substantially horizontal axis of drilling operation, and which is particularly useful in mining and in tunnel excavation work.

Modern drilling rigs are often equipped with a drill boom rotatable to different positions about an axis extending essentially parallel to the longitudinal axis of the drilling apparatus.

This type of drill boom has certain advantages as compared with other types. For instance, it is simple to operate, and the construction is well suited for mechanizing and programming the boom movements.

In a known embodiment of such drilling apparatus provided with a rotatably positionable drill boom, the positioning movement is performed by means of hydraulic motors and racks. This requires that the positioning movement is limited, generally to 370°–400°, i.e., a little more than one revolution.

In another earlier drilling apparatus the rotating movement is carried through by means of two angularly positioned hydraulic jacks connected to a crank pin on the rotational shaft of the boom. This construction allows for an unlimited rotational movement which, however, cannot be utilized due to the fact that hose connections for transferring different working fluids to the boom extend between the fixed frame and the rotatable beam, said hose connections limiting the rotational movement.

An unlimited rotational movement would provide important advantages. Thus it would save time if all bore holes could be drilled in turn, without requiring extra positioning movements of the boom, i.e., without requiring that the boom has to be moved back to a determined starting position when the drilling of a series of holes has been concluded and the drilling of a new series is to be started. Furthermore, an unlimited rotational movement greatly simplifies mechanizing and programming of the drilling operations.

Therefore, one object of the invention is to provide for unlimited rotational positioning movement of the drill boom. This object has been attained by providing a fluid collector means for transferring operating fluids so as to allow an unlimited rotational positioning movement of the drill support boom while transferring said fluids.

By providing a collector device according to the invention the need for utilizing hoses for transferring hydraulic liquid, air and water between the frame of the apparatus and the drill boom is eliminated, and the drill boom is therefore unlimitedly rotatable to different drilling positions.

Another object of the invention is to provide a very simple and compact arrangement for driving a shaft carrying the boom positioning mechanism.

Another object of the invention is to provide a drilling apparatus incorporating an improved fluid collector means for transferring operating fluids.

In carrying out the invention, in one preferred form thereof, there is provided a drilling apparatus comprising a frame, a drill boom carrying a fluid operated drill means, a fluid operated positioning mechanism for moving said boom to different positions, said mechanism being rotatable about a central longitudinal axis with respect to said frame, drive means in said frame for rotating said mechanism, conduit means leading from said frame for conducting operating fluids to said mechanism and flushing fluid and operating fluids for said drill means, said conduit means including a collector means for transferring said fluids, said collector means being positioned in said frame coaxially with the axis of rotation of said mechanism so as to allow an unlimited rotational movement of said mechanism while transferring said fluids, said collector means comprising two collector units including a stator unit and a rotor unit, said stator unit being fixed with respect to said frame and having input conduit connections for said fluids, said rotor unit being mounted coaxially with said stator unit for rotation together with said mechanism and having output conduit connections for said fluids, said stator unit comprising channel means communicating with said input conduit connections, said rotor unit comprising channel means communicating with said output conduit connections, at least one of said collector units further comprising peripheral groove means connecting said channel means of said respective collector units, one of said collector units comprising two coaxially arranged inner and outer cylindrical parts with a radial spacing between the outer circumference of the inner cylindrical part and the inner circumference of the outer cylindrical part, and the other one of said collector units comprising a cylindrical sleeve-like member positioned within said radial spacing between said inner and outer cylindrical parts.

By means of so called "rota booms" equipped with parallelogram links, automatic parallelism between the bore holes is obtained only if drilling is performed in the length direction of the rotational positioning shaft. If drilling is performed perpendicularly to the rotational positioning shaft, the bore holes are directed in a fan-shaped pattern. This is of secondary importance if the apparatus is used only for drilling, but is detrimental in working sites where the drilling apparatus is used for drilling operations of different and varying kinds, such as for instance, vertical open cut mining or horizontal top slicing.

In order to eliminate this disadvantage, the positioning mechanism is preferably swingably carried by a transverse rotational shaft extending perpendicularly with respect to the central longitudinal axis, the rotational movement about said longitudinal axis being transferred to said transverse shaft. By this simple arrangement it is possible to provide for automatic parallelism between the bore holes during drilling perpendicularly to the axis of rotation of the drill boom.

Further objects and advantages of the invention will be apparent from the following description and the accompanying drawings, in which.

Figure 1:
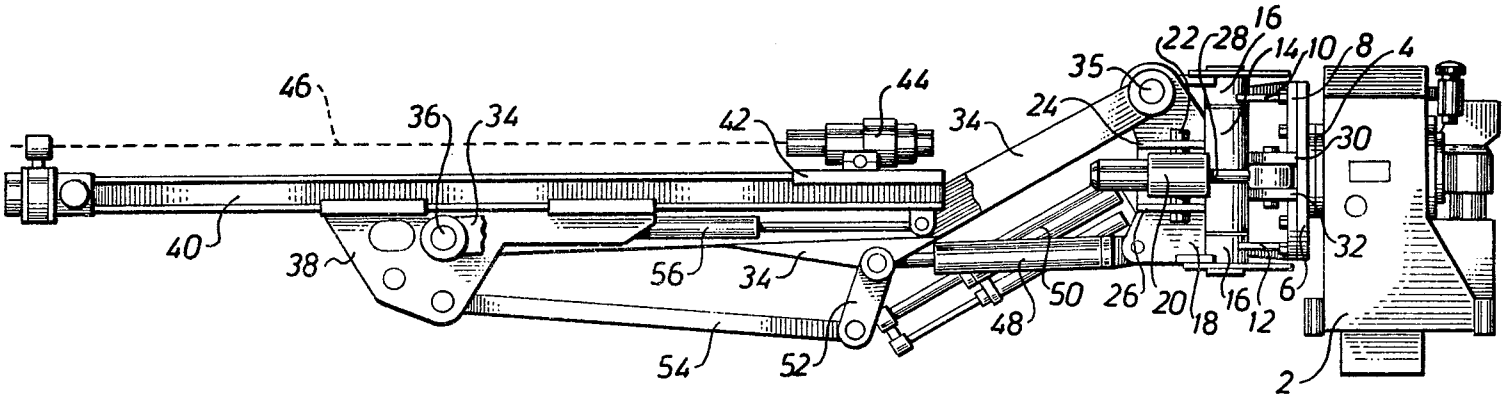
FIG. 1 is a side view illustrating a drilling apparatus in accordance with the present invention.

The drilling apparatus according to the invention illustrated in FIG. 1 comprises a frame 2 which can be located on a bed, not shown, e.g. a transport vehicle or the like. The frame 2 carries drum shaped rotatable output shaft 4 ended by an annular flange 6. An annular disc 8 is bolted to the flange 6 and by means of fork-like extensions 10 and 12 carries a cylindrical bearing member 14 extending parallel to the planes of the flange 6 and the disc 8. Member 14 rotatably carries a shaft 16 forming part of a bracket 18 for a drill maneuvering or positioning mechanism of the drilling apparatus. More particularly the shaft 16 comprises two shaft heads arranged at opposite ends of the cylindrical member 14.

For rotating the shaft 16 of the bracket 18 in the cylinder 14 a hydraulic jack is located on each side of the bracket, the cylinder 20 of said jack being rotatably mounted about a pivot 22 parallel to the shaft 16 and extending between two fork-like side extensions 24 and 26 of the bracket 18. In a similar way the piston 28 of the jack is rotatably connected by its free end to the disc 8 between fork-like axially extending extensions 30 and 32 of said disc.

The maneuvering or positioning mechanism carried by the bracket 18 comprises two angularly bent parallel booms 34, rotatably journalled at one end thereof in the bracket 18 about a pivot 35.

For the sake of clarity the nearest boom in the view of FIG. 1 has been partly cut away. At their far ends the booms 34 rotatably carry a member 38 on a pivot 36. A drill feed rail 40 is slidably arranged in said member 38. The feed rail 40 carries a drill apparatus slide 42, on which a pneumatically operated drill 44 is mounted. A drill bit is indicated at 46 with broken lines.

The maneuvering or positioning means for the different positioning movements of the drill in a plane common to the shaft 16 and the rail 40 may be of a conventional kind and do not form part of the invention, and they shall therefore only be described briefly here. Thus, two parallel boom operating jacks 48 for the lifting and lowering movements of the booms are mounted between the bracket 18 and the knees of the booms 34. A jack 50 extends between the brackets 18 and a pair of links 52, 54 for swinging the member 38 about the pivot 36, and a jack 56 is arranged for the sliding movement of the feed rail 40 in the member 38. By means of the maneuvering elements described it is thus possible to lift and lower the booms 34 about the pivot 35 and to position the member 38 and thus also the feed rail 40 angularly with respect to the booms 34, and to displace the feed rail in the member 38. Furthermore, the bracket 18 and thus the whole drill maneuvering mechanism may be rotated about the shaft 16, which may be angularly positioned by means of the shaft 4.

By means of the possible movements described the drill 46 may be positioned in an arbitrary drilling direction with respect to the frame 2, and for drilling e.g. perpendicularly with respect to the shaft 4 of a series of bore holes, it is possible to position the holes in a mutually parallel plane thanks to the possibility of rotating movement about the shaft 16.

For rotating the shaft 4 a rotary gear train, to be described more fully below, is arranged in the frame 2, said gear train being operated by a hydraulic motor. Operating fluids, such as water and air for the drill 44 and hydraulic oil for the respective jacks are transferred via a collector disposed in the shaft 4.

Figure 2:
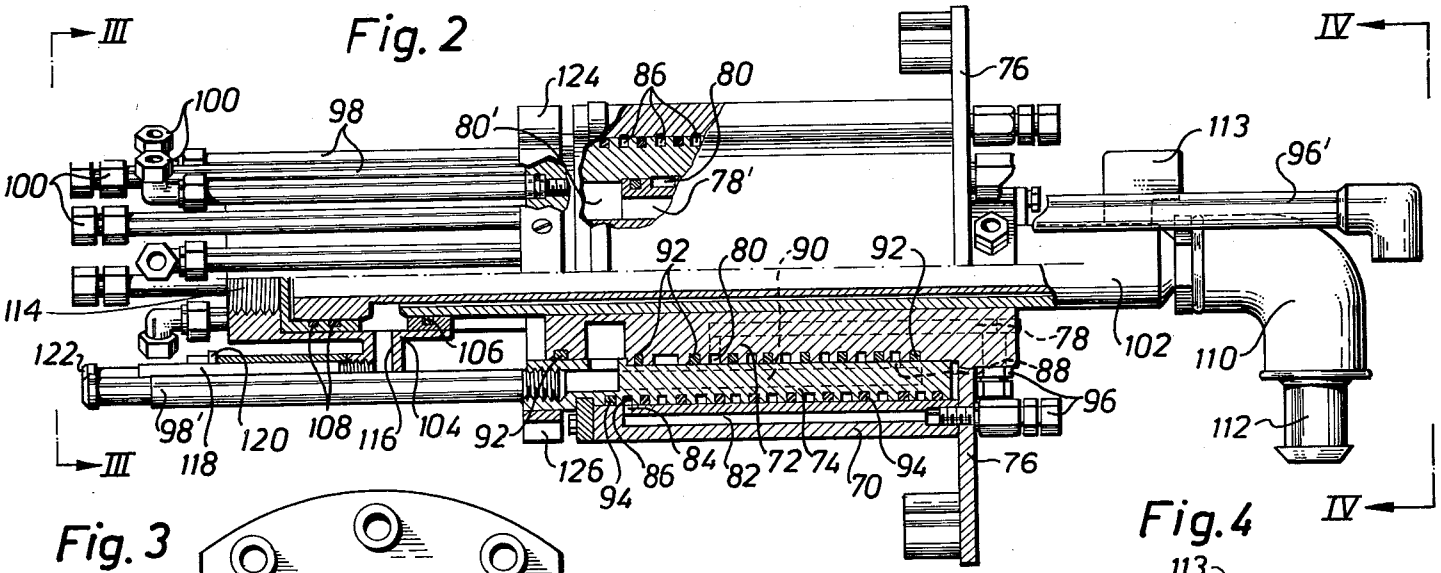
FIG. 2 is a side view, partly in section, illustrating a collector device included in the apparatus of FIG. 1.

FIG. 2 is an enlarged detail view of the fluid collector which is mounted within shaft 4 of FIG. 1. The collector comprises an outer cylindrical stator part 70 and an inner cylindrical stator part 72 coaxial therewith, a cylindrical sleeve-like rotor member 74 being coaxially disposed between said stator parts. The stator unit 70, 72 carries a mounting plate 76 at one end. Mounting plate 76 rigidly supports the stator unit upon frame 2 (FIG. 1). A number of channels 78 extend axially in the stator part 72, said channels at their inner ends located in the stator part 72 communicating with an annular groove 80 each in the outer mantle surface of the stator part 72.

The outer stator part 70 in a similar way comprises axially extending channels 82 extending through the mounting plate 76. The inner ends of the channels 82 by means of short radial channels 84, communicate with annular grooves 86 in the outer mantle surface of the rotor member 74. The grooves 80 and 86 communicate by means of short radial channels, one being shown at 88 in FIG. 2, with axially extending channels 90 in the rotor body, the channels 90 opening at the left hand end of the rotor (FIG. 2). All annular grooves 80 and 86 are on both sides surrounded by O-seals 92 and 94, respectively, disposed in grooves in the mantle surface of the inner stator and in grooves in the outer mantle surface of the rotor, respectively, and serving as seals for the grooves 80 and 86.

Pipe or hose connectors, indicated at 96, are provided at the inputs of the channels 78 and 82. At the outputs of the channels 90 connecting tubes 98 are screwed into the rotor, said tubes at their ends having pipe or hose connecting means 100.

The stator unit and the rotor unit of the collector are sometimes referred to hereinafter generically as simply "collector units".

A double-walled conduit 102, comprising two coaxially extending tubes, is disposed centrally in the stator part 72, said conduit extending a distance beyond both ends of the collector, as thus far described. The double-walled conduit 102 forms two fluid transferring channels, viz. one inner channel and one channel between the walls of said tubes. At the output end thereof the inner tube extends beyond the outer tube, both tubes being surrounded by a sleeve 104 at said end. The sleeve 104 is sealed with respect to the peripheries of the outer and inner tubes, respectively, by means of O-seals 106 and 108. A pipe 110 is connected to the input end of the inner tube, the pipe 110 at its free end having a hose nipple 112. The space between the outer and inner tubes of the double-walled conduit 102 is connected, at the input end, to a pipe 113. The sleeve 104 at the output end thereof has threads 114 for connecting an outer line receiving the fluid flowing through the inner tube.

Furthermore, the sleeve 104 has a radially extending elbow pipe 116 forming an output from the outer channel of the double-walled conduit 102 and ended by a connecting tube 118 which, by means of a locking disc 120, is rigidly joined to two of the tubes 98 located on opposite sides of the tube 118. At the output end thereof the tube 118 has a hose nipple 122. By means of the locking disc 120 the rotor sleeve 104 is rigidly connected with the rotor member 74 for rotation therewith with respect to the stator unit.

The rotor member 74, at its output end, extends some distance beyond the stator parts 70 and 72 and around its periphery has an end ring 124 with a notch 126, the function of which is described below.

In the embodiment shown, the respective transferring lines and channels of the collector serve the following purposes. By means of the channels 82 and 78 in the outer and inner stator parts respectively, and the associated radial channels, grooves, and output tubes 98, hydraulic liquid is transferred to the hydraulic jacks described above and intended for the different positioning movements of the drill boom. By means of two larger ones of the channels 78, referenced 78' in FIG. 2 and having input tubes 96' and an annular output channel 80' in the stator part 72, and the corresponding output tube 98', air for the rotary motor of the pneumatically operated drill 44 is transmitted. By means of the inner transferring channel in the double conduit 102 and the corresponding input tube 110 and output at 114, pressurized air for the percussion motor of the drill 44 is transferred. Flushing water for the drill is transferred by means of the annular space between the walls of the double-walled conduit 102 and the corresponding input 113 and output tube 118.

Figure 3:
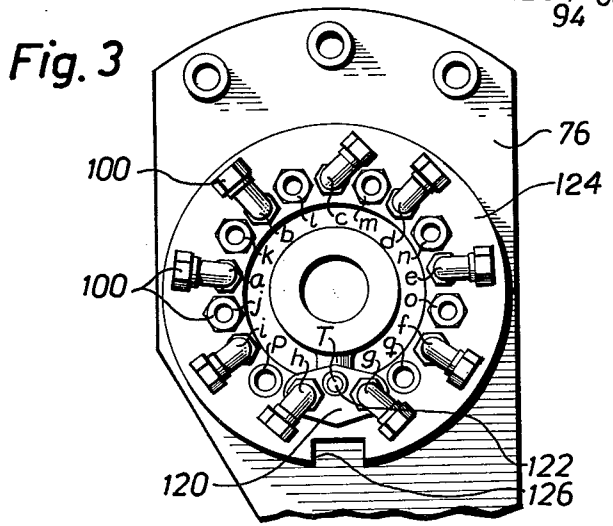
FIG. 3 shows an end view of the collector apparatus in the direction of arrows III—III in FIG. 2.

FIG. 3 is a partial view from the left end of the collector of FIG. 2, as indicated at III—III in FIG. 2.

Figure 4:
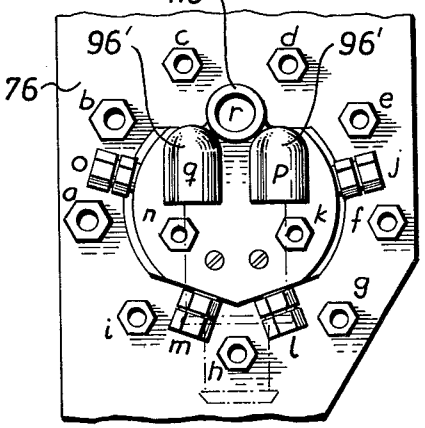
FIG. 4 shows an end view of the collector apparatus in the direction of arrows IV—IV in FIG. 2.

FIG. 4 is a partial end view taken at the right end of the collector of FIG. 2, as indicated at IV—IV in FIG. 2. In this figure, the double-walled central conduit connection pipe 110 and nipple 112 are shown only in phantom in order to clearly illustrate the other parts which would otherwise be obscured. The various individual output connections are identified by individual lower case letters in FIG. 3, and the corresponding input connections are indicated by corresponding lower case letters in FIG. 4.

Thus, independent transmission of each of the needed operating fluids for the drill boom is carried through by means of the collector device described above.

Figure 5:
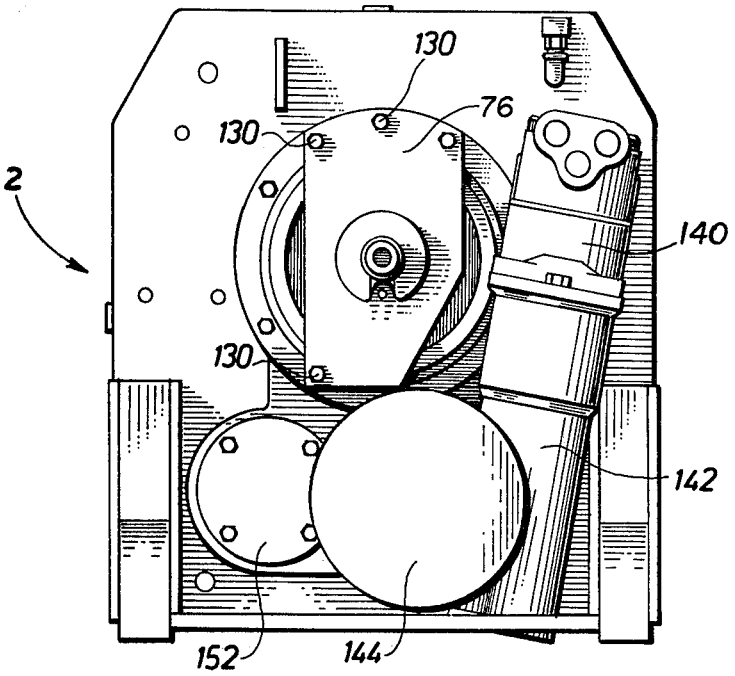
FIG. 5 is an enlarged end view showing the right end of the frame of the apparatus of FIG. 1.
Figure 6:
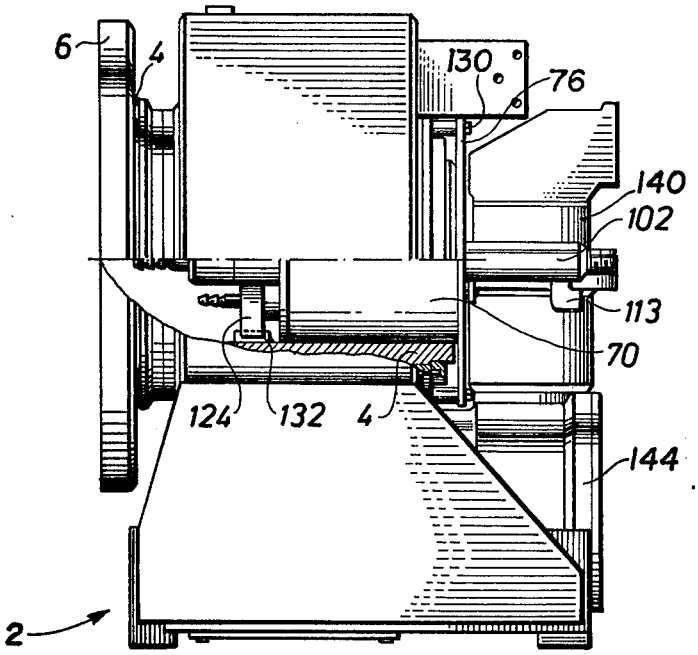
FIG. 6 is an enlarged side view of the frame of the apparatus of FIG. 1, with parts cut away and in section for illustrating the location of the collector in the frame.

The location of the collector in the frame 2 is illustrated in FIGS. 5 and 6. Particularly referring to FIGS. 5 and 6, the positioning shaft 4 is in the form of a hollow cylinder rotatably journalled in a through opening in the frame 2 and includes an end flange 6. The mounting plate 76 which is rigidly connected to the stator parts 70 and 72, is mounted to the frame by means of bolts 130. The cylindrical shaft 4, on its inner surface has a protrusion 132 engaging with the notch 126 in the end ring 124 of the collector, the collector rotor 74 thereby being connected for rotation with the shaft 4.

The shaft 4 is rotated by means of a rotary gear train described more fully below which is operated by a rotary hydraulic motor 140. The hydraulic motor may be of conventional construction and need not therefore be described more fully here.

Figure 7:
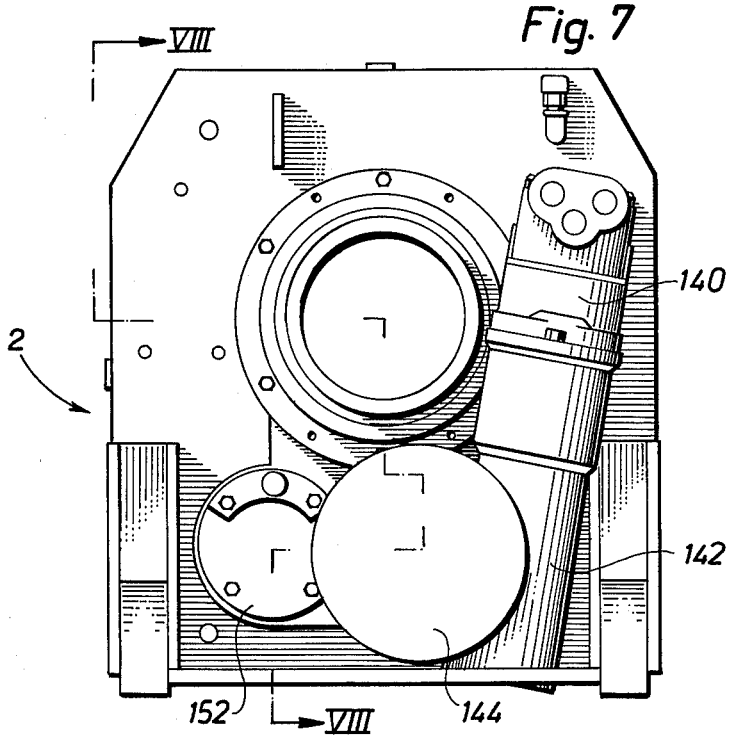
FIG. 7 is an end view of the frame of the apparatus, generally corresponding to the end view of FIG. 5, but with certain parts removed for greater clarity.
Figure 8:
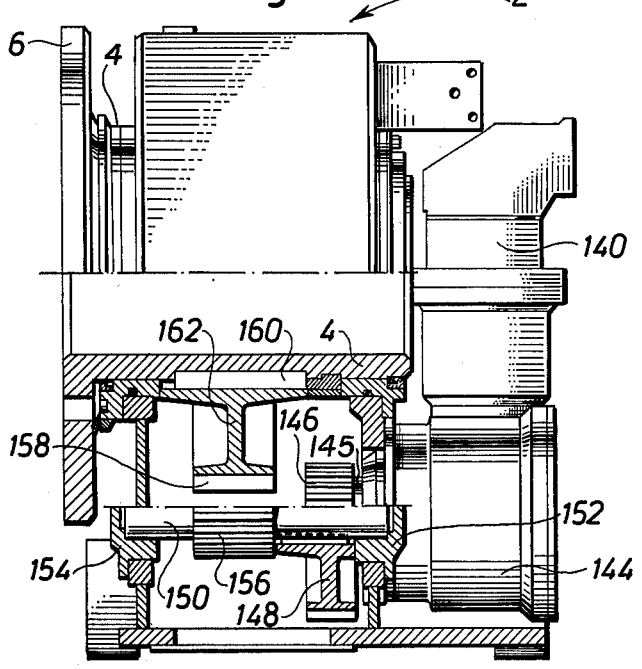
FIG. 8 is a side view of the frame of the apparatus generally corresponding to FIG. 6, with different parts cut away and shown in section to illustrate a gear train within the frame of the apparatus.

Attention is particularly directed to FIGS. 7 and 8, which generally correspond to FIGS. 5 and 6, but with different parts omitted or shown in section to illustrate different features. FIGS. 7 and 8 are particularly concerned with the illustration of the drive system for the shaft 4. Referring particularly to those figures, the output shaft of the hydraulic motor 140 drives a worm wheel, the mounting of the casing of which in the frame 2 is illustrated at 142. The worm wheel and a toothed wheel meshing therewith, the mounting of the casing of which in the frame 2 is illustrated at 144, form together a worm gear train driving a shaft 145 (FIG. 8) and a gear 146 meshing with a gear 148 mounted on a shaft 150 and rotatably mounted in the frame. Journal caps for the shaft 150 are shown at 152 and 154.

The shaft 150 carries a further gear 156 meshing at 158 with a gear 162 wedged onto the shaft 4 at 160. The rotary gear train described above in a practical embodiment has an output torque of 2000 kpm and a total gear ratio of 835:1.

The unlimited rotational movement of the drill boom obtained by the arrangement described above provides important advantages. Thus, no additional movements of the boom are needed, as described above, to move it to e.g. a determined starting position for drilling of bore holes, which may therefore be drilled in turn in an arbitrary sequence. Furthermore, the unlimited rotational movement has a great importance for mechanizing and programming the drilling work.

The arrangement according to the invention, comprising a hydraulic motor and a rotary gear train driving a positioning shaft with a collector of the kind described above, furthermore reduces the overall dimensions of the frame.

I claim:

1. Drilling apparatus comprising a frame, a drill boom carrying a fluid operated drill means, a fluid operated positioning mechanism for moving said boom to different positions, said mechanism being rotatable about a generally horizontally extending axis with respect to said frame, a cylindrical sleeve member coaxial with said axis forming a rotational shaft for said mechanism in said frame and comprising mounting means for said mechanism, a stator unit attached to said frame and forming a unitary support bearing coextensive with said sleeve member and engaging both the inside and outside of said sleeve member for support thereof, a multiple channel conduit means leading through said cylindrical sleeve member from said frame for conducting operating fluids to said mechanism and flushing fluid and operating fluids for said drill means, motor drive means comprising a rotary gear train coupled for rotating said cylindrical sleeve member, said cylindrical sleeve member including a toothed gear wheel on the outer periphery thereof forming the output portion of said rotary gear train.

2. Apparatus according to claim 1 wherein the input portion of said rotary gear train includes a worm gear, and wherein there is provided a hydraulic motor connected to drive said worm gear.

3. Apparatus as claimed in claim 1 wherein said positioning mechanism includes a rotational shaft extending perpendicularly with respect to said horizontally extending axis for swinging movement of said boom, the rotational movement about said horizontally extending axis being transferred to said boom through said last-mentioned rotational shaft.

4. Apparatus as claimed in claim 3 wherein there is provided a jack means arranged in a plane which is perpendicular with respect to said rotational shaft for swinging said boom to different positions about said rotational shaft.

5. Drilling apparatus as claimed in claim 1 wherein said conduit means includes a collector means for transferring said fluids, said collector means being positioned in said frame coaxially with said horizontally extending axis of rotation of said mechanism so as to allow an unlimited rotational movement of said mechanism while transferring said fluids, said collector means comprising two collector units including a stator unit and a rotor unit, said stator unit being fixed with respect to said frame and having input conduit connections for said fluids, said rotor unit being mounted coaxially with said stator unit for rotation together with said mechanism and having output conduit connections for said fluids, said stator unit comprising means communicating with said input conduit connections, said rotor unit comprising channel means communicating with said output conduit connections, at least one of said collector units further comprising peripheral groove means connecting said channel means of said respective collector units, one of said collector units comprising two coaxially arranged inner and outer cylindrical parts with a radial spacing between the outer circumference of the inner cylindrical part and the inner circumference of the outer cylindrical part, and the other one of said collector units comprising a cylindrical sleeve-like member positioned within said radial spacing between said inner and outer cylindrical parts.

6. Apparatus as claimed in claim 5 wherein said peripheral groove means connecting said channel means comprising a series of circumferential grooves in the outer peripheral surface of said inner cylindrical part and in the outer peripheral surface of said cylindrical sleeve-like member.

7. Apparatus as claimed in claim 6 wherein said channel means of said collector unit comprising a cylindrical sleeve-like member are in communication with said peripheral grooves in both said inner cylindrical part and said cylindrical sleeve-like member.

8. Apparatus as claimed in claim 5 wherein said stator unit is the collector unit comprising two coaxially arranged inner and outer cylindrical parts.

9. Apparatus as claimed in claim 8 wherein there is provided a double-walled conduit means having an inner central conduit and an outer conduit defined between the walls of said conduit means, input connections to said inner and outer conduits, said double-walled conduit means being positioned centrally within said collector means with the axis of said conduit means coincident with the axis of said collector means, said rotary unit of said collector means including a cylindrical rotor part rotatably mounted upon said double-walled conduit means at the output end thereof and defining an output connection from said outer conduit.

* * * * *

UNITED STATES PATENT AND TRADEMARK OFFICE

CERTIFICATE OF CORRECTION

PATENT NO. : 4,108,254

DATED : August 22, 1978

INVENTOR(S) : AKE JOHANSSON

It is certified that error appears in the above-identified patent and that said Letters Patent are hereby corrected as shown below:

Column 4, line 14, after the period (.) the following sentence should appear:--Rotor member 74 is sometimes referred to hereinafter as a cylindrical sleeve member.--

Signed and Sealed this

Sixth Day of March 1979

[SEAL]

*Attest:*

RUTH C. MASON
*Attesting Officer*

DONALD W. BANNER
*Commissioner of Patents and Trademarks*